United States Patent [19]

Anderson

[11] Patent Number: 4,480,674

[45] Date of Patent: Nov. 6, 1984

[54] MAGNETIC ACTUATING MECHANISM FOR PIVOTAL VENETIAN BLIND ASSEMBLY

[75] Inventor: Richard N. Anderson, Owensboro, Ky.

[73] Assignee: Hunter Douglas Inc., Totowa, N.J.

[21] Appl. No.: 404,468

[22] Filed: Aug. 2, 1982

[51] Int. Cl.[3] ..... E06B 3/32

[52] U.S. Cl. ..... 160/107

[58] Field of Search ..... 160/107, 168–178, 160/236

[56] References Cited

U.S. PATENT DOCUMENTS

| | | |
|---|---|---|
| 2,489,879 | 11/1949 | Grebe . |
| 2,557,978 | 6/1951 | Krumm . |
| 3,022,549 | 2/1962 | Cummings . |
| 3,129,471 | 4/1964 | Johnson et al. . |
| 3,153,819 | 10/1964 | Bond . |
| 3,253,644 | 5/1966 | Gotah et al. . |
| 3,292,309 | 12/1966 | Honner . |
| 3,719,221 | 3/1973 | Hanson . |

FOREIGN PATENT DOCUMENTS

| | | |
|---|---|---|
| 1313315 | 11/1962 | France . |
| 2095958 | 2/1972 | France . |
| 204755 | 3/1966 | Sweden . |

*Primary Examiner*—Peter M. Caun

*Attorney, Agent, or Firm*—Pennie & Edmonds

[57] ABSTRACT

A magnetic actuating mechanism for a pivotal venetian blind assembly. The mechanism includes a linear movable operating element in the form of a split housing operatively connected by connection means to a hanger pivot member supporting a plurality of slats. The split housing forms two housing sections each having a magnet therein. The hanger pivot member has a body portion the length of which is equal to a slat width and a bearing section spaced from an end slat.

12 Claims, 13 Drawing Figures

FIG. 2
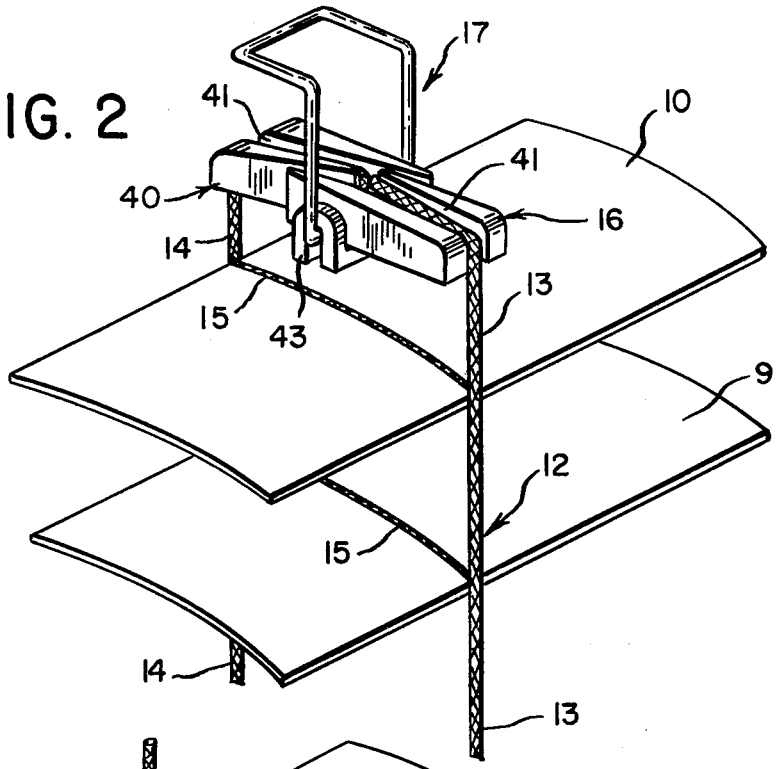
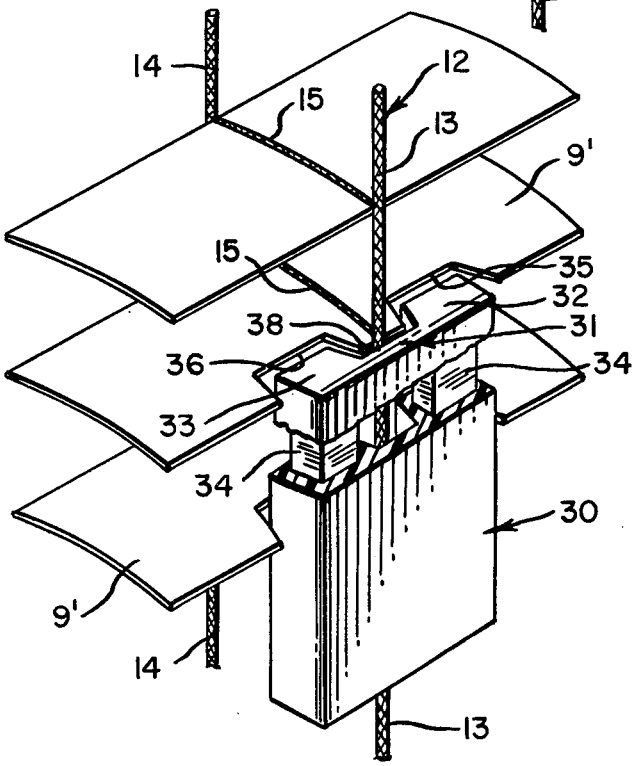
FIG. 3

MAGNETIC ACTUATING MECHANISM FOR PIVOTAL VENETIAN BLIND ASSEMBLY

TECHNICAL FIELD

This invention relates to a magnetic actuating mechanism for a pivotal venetian blind assembly and more specifically to a tilting transfer mechanism adapted to be positioned between glazing and to a means for pivotally mounting the blind assembly between glazings.

CROSS-REFERENCE TO OTHER APPLICATIONS

The subject matter of this application relates generally to similar subject matter disclosed in my copending applications Ser. No. 332,812 filed Dec. 21, 1981 and Ser. No. 387,035 filed June 10, 1982.

BACKGROUND OF THE INVENTION

Venetian blind assemblies have been utilized in window units where the blind assembly is positioned behind glazing in any number of different ways. For example, the blind assembly may be adjacent a single pane of glass, may be positioned between two panes, or even positioned in a triple pane window unit. In those units having two or more panes, blind assemblies may in addition be sealed with respect to the panes such that the unit forms a hermetically sealed window unit to provide superior insulation properties. In all forms of units, including single and multiple pane constructions and unsealed and hermetically sealed constructions, it is desirable to have a single effective pivoting or tilting control mechanism by which the tilt of individual slats of the blind assembly may be easily and accurately regulated using a minimum of force and where the degree of force necessary to pivot or tilt the slats remains substantially uniform during the complete range of tilting.

It is also desirable in order to facilitate placement in a window unit that the venetian blind be fully reversible in a window opening, that is to say, that the top and bottom ends of the blind be reversible in the unit or that the top and bottom ends of the unit be reversible. This reversible feature in turn requires a tilting transfer mechanism which may work equally as well in one position of the blind assembly or window unit as in a reverse position.

Further it is desirable in window units having two or more spaced panes that the slats of the blind assembly in the open position occupy as much of the space between the panes as possible in order to reduce expense of blind assembly and to reduce operating forces. If smaller width slats are utilized where the width of the slat is substantially less than the space between panes, more slats will be required to completely close the window opening thus increasing expense of manufacture and assembly as well as forces necessary to operate the tilting mechanism.

Magnetic couplings have been proposed for hermetically sealed window units to connect an operable member exterior of the unit to a blind operating element on the interior of the unit. See for example U.S. Pat. Nos. 3,022,549 dated Feb. 27, 1962 and 3,129,471 dated Apr. 21, 1964. A problem with such magnetic couplings to date has been to design one which is small in size and which will at the same time have sufficient coupling strength to enable the slats of the blind to be tilted throughout their complete operating range. A further problem with some of the magnetic couplings to date, and particularly when used in units having only a small spacing between glazings, is that when the operating element is connected by a connecting means, for example a tape cable, to a hanger pivot member supporting the slats, lateral forces will be imparted on the connecting means to displace it inwardly towards the slats due to the thickness of the operating element. This inward displacement may result in the connecting means interferring or binding with the edge of slats adjacent the operating element resulting in deformation of these slats and increase in operating force necessary to tilt the slats.

It has been proposed to have cutouts in the slats adjacent the operating element to accommodate the thickness of the operating element to reduce the inward displacement of the connecting means. However, when the connecting means comprises a tape cable, separate provision has to be made to prevent longitudinal displacement of the slats since the tape cables in the area of the cutouts no longer will prevent such longitudinal displacement.

Venetian blind assemblies are in addition conventionally suspended in a window or other frame opening from a complex headrail assembly which contains tilting and lifting hardware. Where greater stability for the blind assembly is required and/or where the blind assembly is not required to be raised or lowered, it may alternatively be suspended within the opening between special heavy top and bottom rails or slats. Such rails are pivotally mounted in the frame opening and the suspension for slats intermediate the rails is secured to the rails. These headrail assemblies and special top and bottom rails are much more expensive than the balance of the blind assembly. Further, since the headrail assemblies and top and bottom rails or slats comprise different components than the rest of the blind assembly, they necessarily complicate and increase the cost of inventory. The use of special top and bottom rails or slats results in a nonuniform coverage of the frame openings and gaps appearing at the suspension edges of the blind assembly.

Since color matching is a very important consideration from an aesthetic viewpoint, it is necessary that the components comprising the headrail assemblies and special top and bottom rails be color matched with the intermediate slats making up the major portion of the blind assembly. This further adds to the cost and complexity of inventory and of the complete blind assembly.

It is therefore an object of my invention to provide for a magnetic coupling connecting an exterior operable control element with an interior operating element of a tilting actuating mechanism of a venetian blind assembly positioned in a window unit where the coupling is small in size and does not interfere with the movement of the slats.

It is a further object of my invention to provide for a magnetic coupling which will cooperate with cutouts in slats to reduce inward displacement of a connecting means extending between the operating element and a hanger pivot member supporting the slats and which at the same time will eliminate the need for any additional means to prevent longitudinal displacement of the slats having cutouts with respect to the connecting means.

It is a still further object of the invention to provide for a hanger pivot member for supporting a plurality of slats which eliminates need of special slats and which at the same time will assure that the force necessary to tilt the slats will remain the same throughout tilting movement of the slats.

GENERAL DESCRIPTION OF THE INVENTION

Broadly a magnetic actuating mechanism constructed according to my invention is adapted for use in a pivotal venetian blind assembly. The assembly in turn has a plurality of adjacent slats supported by support means in the form of at least one tape cable in turn supported by a hanger pivot member adapted to be pivotally mounted with respect to a frame member. The hanger pivot member is adjacent one end slat of the plurality of slats. A linearly movable operating element is operatively connected to the hanger pivot member by a connection means so that linear movement of the operating element will move the connecting means to cause the hanger pivot member to pivot with respect to the frame member while at the same time the individual slats will be tilted by the supporting means. The operating member is magnetically coupled to a linearly movable operatable member. The operating element according to the invention comprises a split housing forming two similar housing sections each containing a magnet. The housing is connected between the two sections to the connecting means. By this construction the connection means, which may comprise a tape cable, a drive cable or other means joined to the hanger pivot member, will have a minimum lateral displacement with respect to the edges of the slats as they are tilted.

Preferably the slats adjacent the housing have two cutouts therein into each of which a housing section extends while the space of the slats between the cutouts extends into the split between the housing sections. By this construction the tape cable or supporting means may be connected to the slats by conventional means to assure proper vertical and longitudinal alignment of the slats.

The hanger pivot member comprises a body portion which is spaced from the end slat where the body portion has a length substantially equal to the width of the slats. Tape cables extend over the ends of the body portion. By this construction the tape cables will not move laterally with respect to the edges of the slats to interfere or bind therewith as the hanger pivot member is pivoted about its pivot point. Further this construction allows the end slat to be identical with the remainder of the slats since it does not have to be of a heavier construction to support the other slats and since no special provision has to be made in order to connect it to the hanger pivot member.

The body portion has slots therein on a side opposite the end slat into which the support means or tape cables may be threaded to provide a connection therewith. In the alternative the tape cables or support means could be connected to the hanger pivot member by glue, welding or other means.

The body portion preferably has a bearing section on the side thereof opposite the slats adapted to engage a suspension bracket connected to a frame member.

In order to provide for a blind assembly which may be used in a number of positions or to provide for a move rigid assembly, further hanger pivot members may be spaced from end slats at both ends of the plurality of slats. In such a construction hanger pivot members spaced from one end of the plurality of slats are connected to suspension brackets on one frame of a wall opening while hanger pivot members spaced from an opposite end of the plurality of slats are connected to suspension brackets on an opposite frame member. Support means, as for example tape cables, extending between the hanger pivot members will then support the slats.

BRIEF DESCRIPTION OF THE DRAWINGS

FIG. 2 an enlarged view of a portion of the window unit of FIG. 1 illustrating a hanger pivot member constructed according to the invention; and, FIG. 3 is an enlarged view of a portion of FIG. 1 illustrating a split housing of a linear movable operating element constructed according to the invention.

BEST MODES FOR CARRYING OUT THE INVENTION

Figure 1:
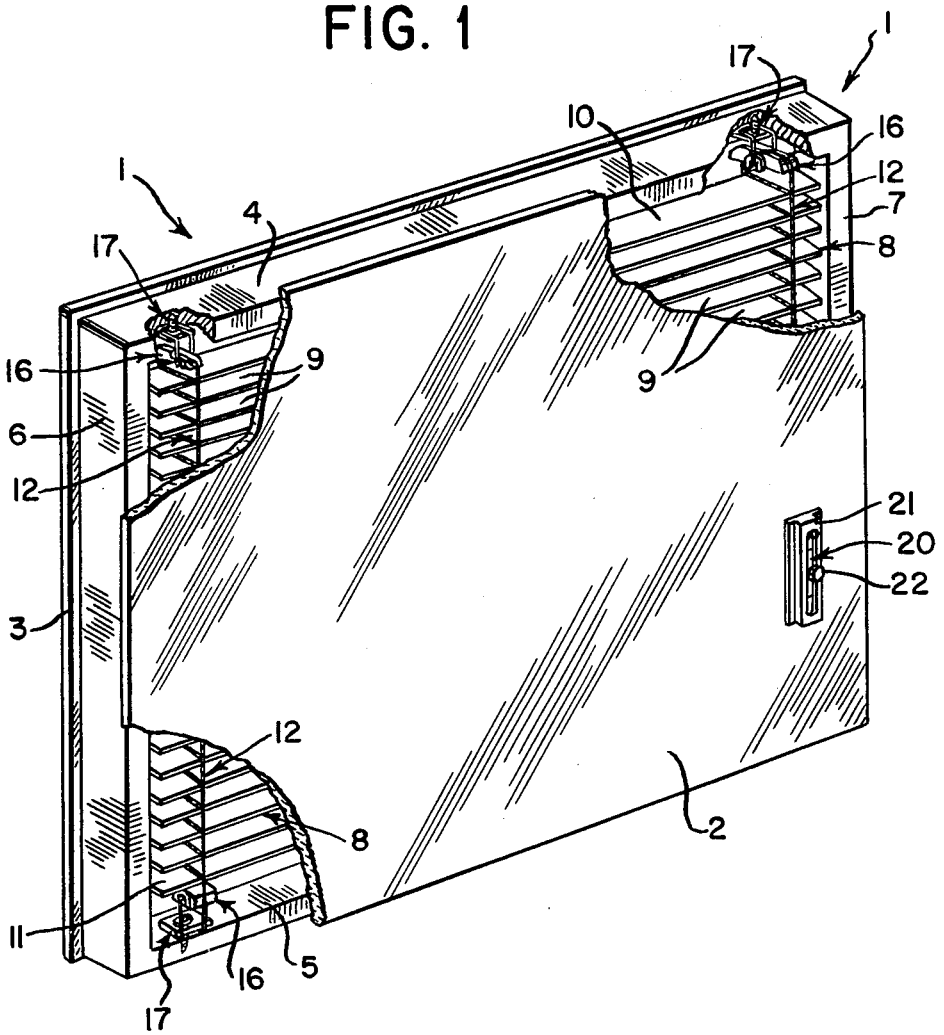
FIG. 1 is a broken perspective view of a glazed window unit having a magnetic actuating mechanism constructed according to the invention.

Referring to FIG. 1 there is illustrated a window unit 1 having glazing 2 and 3 fixed to upper and lower frame members 4 and 5 and side frame members 6 and 7 of the unit. A venetian blind assembly 8 is positioned in the unit between the glazing, and if desired, the unit may be hermetically sealed to provide good insulation properties.

The blind assembly 8 comprises a plurality of adjacent slats 9 including end slats 10 and 11 all of which are supported by support means in the form of tape ladders 12 each comprising a front tape cable 13 and, as shown in FIGS. 2 and 3, a rear tape cable 14 joined by upper rungs 15 and lower rungs, not shown. The assembly also includes hanger pivot members 16 which are pivotally mounted with respect to the frame members 4 and 5 by suspension brackets 17.

A linear movable operable element 20 is movable in slide 21 by knob 22 which is threaded in the element 20 in order that it may be tightened with respect to the slide to lock the operable element in place.

Operable element 20 is magnetically coupled with a linear movable operating element 30 which as shown in FIG. 3 comprises a split housing 31 forming two housing sections 32 and 33 each of which carries a magnet 34 to cooperate with magnets carried in the operable element 20 so as to form a magnetic couple between the two elements.

As shown in FIG. 3 the slats 9' adjacent the operating element 30 each have two cutouts 35 and 36 therein in order to accommodate the sections 32 and 33 containing the magnets 34. The portion of the slats 9' between the cutouts 35 and 36 extend into the space between the two sections 32 and 33 forming the split housing and this portion is connected to the cable 13 by way of upper and lower rungs as shown, or if no rungs are provided, directly to the cable 13 by clamps or other means. Thus it is seen that by this arrangment the slats 9' are supported in the same manner as the slats 9 and that any additional structure, such as clamps clamping the upper and lower rungs to any reduced portion of a slat at a cutout or a separate tape ladder means connecting slats 9' and 9 are not necessary to assure vertical and longitudinal alignment of all the slats.

The tape cable 13 is connected at one point to the split housing between the sections 32 and 33 by an adhesive or any other means. Because of the extreme thinness of the split housing at the web 38 joining the two sections, the cable 13 is not depressed or displaced laterally with respect to the slats to any substantial extent so that no undue interference would occur between the cable and the edges of the slats 9 not having cutouts resulting in possible deformation of the slats or increase in force necessary to tilt the slats.

The hanger pivot member 16 as shown in FIG. 2 comprises a body portion 40 having a length substantially equal to the width of the slats 9 and over the ends of which the tape cables 13 and 14 extend. Further as shown, the hanger pivot member is spaced from the end slat 10. The result of this construction is that no undue lateral force is exerted on the end slat which could result in deformation of the slat nor does the end slat have to be configured to make a connection with the hanger pivot member. Thus the end slat may be identical with the slats 9 thus reducing inventory requirements.

The body portion 40 has a plurality of slots 41 on a side thereof opposite an end slat through which the ends of the tape cables may be threaded in order to fasten the cables to the hanger pivot member. The cables could also be fastened to the pivot member by an adhesive or other means.

The opposite side of the body portion 40 from the slots 41 has a bearing section 43 which engages with the suspension bracket 17 so as to form a pivotal connection with respect to a frame member. As shown, the bottom of the bearing section 43 is spaced above the end slat 19 a distance equal to approximately one-half the width of the slat. This construction assures that the pivot axis of end slat 10, as well as the remainder of the slats, will remain in alignment with the pivot axis of the hanger pivot member throughout the range of tilting of the slats.

As shown in FIG. 1 the window unit preferably has two or more hanger pivot members spaced from one end slat 10 and two or more members spaced from an opposite end slat 11. In this manner the supporting means comprising the tape cables may support the slats in any orientation of the unit. Thus the unit could be inverted, tipped or inclined with respect to a vertical plane and the slats will still be maintained in proper alignment by the cables.

While I have shown the magnetic actuating mechanism and hanger pivot members as used with a double glazed window unit, the mechanism and pivot member would be equally applicable for use with unglazed, single glazed or even triple glazed units.

I claim:

1. A magnetic actuating mechanism for a pivotal venetian blind assembly having a plurality of adjacent slats including an end slat at each end thereof, at least one tape cable forming a part of a supporting means supporting said slats, a hanger pivot member adapted to be pivotally mounted with respect to a frame member positioned adjacent each end slat of said plurality of slats supporting a tape cable therebetween, a linearly movable operating element, connecting means operably connecting said operating element with each hanger pivot member, a linearly movable operatable element and magnet means operatively connecting said operable element with said operating element, characterized in that said operating element comprises a split housing forming two similar housing sections, in that each housing section has a magnet therein and in that said housing is connected betwen said sections to connecting means.

2. A magnetic acutating mechanism according to claim 1 further characterized in that said split housing is formed by a notch in said housing on a side thereof facing said slats.

3. A magnetic actuating mechanism according to claim 2 further characterized in that a plurality of slats adjacent said housing each have two cutouts therein to accommodate said sections.

4. A magnetic actuating mechanism according to claim 3 further characterized in that said connecting means comprises a tape cable.

5. A magnetic actuating mechanism according to claim 3 further characterized in that said slats adjacent said housing having said cutouts therein are connected to said cable at the widest part of said slats between said cutouts.

6. A magnetic actuating mechanism according to claim 1 further characterized in that said hanger pivot member comprises a body portion spaced from an end slat and in that the length of the body portion is substantially equal to the width of a slat.

7. A magnetic actuating mechanism according to claim 6 further characterized in that a tape cable extends over each longitudinal end of said body portion whereby when said hanger pivot member is pivoted with respect to a frame member, said slats will be tilted by a cable without lateral forces being exerted on said slats by the cable.

8. A magnetic actuating mechanism according to claim 7 further characterized in that a side of said body portion facing outwardly on an end slat has a plurality of slots therein through which tape cables may be threaded to fasten the same to said hanger pivot member.

9. A venetian blind hanger pivot member for a venetian blind having a plurality of adjacent slats including an end slat at one end thereof wherein said hanger pivot member is adapted to be pivotally mounted with respect to a frame member and tape cables forming part of a slat supporting means, characterized in that said hanger pivot member comprises a body portion spaced from said end slat, in that the length of said body portion is substantially equal to the width of said slats and in that said tape cables extend over the length of said body portion whereby when said hanger pivot member is pivoted with respect to a frame member, said slats will be tilted by said cables without lateral forces being exerted on said slats by said cables.

10. A venetian blind hanger pivot member according to claim 9 further characterized in that a side of said body portion facing outwardly on said end slat has a plurality of slots therein through which tape cables may be threaded to fasten the same to said hanger pivot member.

11. A venetian blind hanger pivot member according to claim 9 further characterized in that said body portion has a bearing section on the side opposite thereof from said slots adapted to engage a suspension bracket connected to a frame member.

12. A venetian blind hanger pivot member according to claim 11 wherein said bearing section is spaced from an end slat a distance equal to substantially one-half the width of said end slat.

* * * * *